US005330109A

United States Patent [19]

Walter

[11] Patent Number: 5,330,109

[45] Date of Patent: Jul. 19, 1994

[54] CONTROL OPERATION OF A CLUTCH DRIVE SYSTEM

[75] Inventor: David T. Walter, Great Linford, England

[73] Assignee: TI Interlock Limited, Bedford, England

[21] Appl. No.: 848,792

[22] Filed: Mar. 10, 1992

[30] Foreign Application Priority Data

Dec. 19, 1991 [GB] United Kingdom ..... 9126900.1

[51] Int. Cl.[5] ..... B02C 23/04

[52] U.S. Cl. ..... 241/30; 241/36; 74/573 R

[58] Field of Search ..... 241/36, 37, 30; 192/85 AA, 110 R; 74/573 R; 29/901

[56] References Cited

U.S. PATENT DOCUMENTS

| | | | |
|---|---|---|---|
| 2,218,580 | 10/1940 | Kennedy . | |
| 3,141,485 | 7/1964 | Bonner, Jr. et al. | 74/573 |
| 4,030,878 | 6/1977 | Kunath | 432/45 |
| 4,377,222 | 3/1983 | Sommer | 192/00.02 R |
| 4,520,297 | 5/1985 | League, IV | 318/490 |
| 4,609,155 | 9/1986 | Garnier | 241/30 |
| 4,635,858 | 1/1987 | Welch et al. | 241/16 |
| 4,709,197 | 11/1987 | Goldhammer et al. | 241/36 |
| 4,988,045 | 1/1991 | Griesedieck, III et al. | 241/36 |
| 5,236,138 | 8/1993 | Stangenberg et al. | 241/36 |
| 5,240,358 | 8/1993 | Hackett et al. | 409/141 |

*Primary Examiner*—Mark Rosenbaum
*Assistant Examiner*—John M. Husar
*Attorney, Agent, or Firm*—Seidel, Gonda, Lavorgna & Monaco

[57] ABSTRACT

A motor-driven drive shaft is coupled to a grinding mill or other unbalanced rotatable member through a clutch arranged to accommodate misalignment, the clutch being so controlled during start-up as to be initially engaged to effect a first limited rotation of the mill in the drive direction, then disengaged to permit the mill to rotate under its own weight through a second rotation in the direction reverse to the drive direction and through a third rotation in the drive direction, and then to be re-engaged during the second rotation of the member in the drive direction. Clutch orbiting is thus reduced if not eliminated.

12 Claims, 2 Drawing Sheets

DRIVEN FRICTION DISCS SPEED

CLUTCH AIR PRESSURE

CONTROL OPERATION OF A CLUTCH DRIVE SYSTEM

FIELD OF THE INVENTION

This invention relates to the control and operation of a clutch drive system, and particularly, but not exclusively, to the drive systems of grinding mill equipment.

BACKGROUND OF THE INVENTION

A typical grinding mill installation, as used in the treatment of ores, comprises an electric motor which drives the actual mill itself through a set of gears. In order to minimise starting current drawn by the motor, when the grinding mill is set in operation, a clutch is included in the drive system. The mill with its unbalanced load is very heavy and to maintain precise alignment between the clutch drive and driven shafts would be a difficult, lengthy and costly exercise, because of dynamic movements occurring in operation. Moreover, if the shafts are aligned in cold conditions they tend to be misaligned after a few hours of running because of differential thermal movements. Also, the gear set generates forces which can combine to yield associated bearing forces that have not only different levels, but also different directions. The clutches employed in grinding mill installations are thus of a kind capable of accommodating misalignment but such clutches can readily exhibit unacceptable orbiting.

It is accordingly an object of the invention to provide a method of and a means for coupling a rotary drive to an unbalanced driven member through a clutch accommodating misalignment between the drive and the load such that clutch orbiting is reduced or eliminated.

SUMMARY OF THE INVENTION

The invention accordingly provides a method of operating an installation in which a rotary drive is applied from a motor through a clutch to a driven member, for example a grinding mill, the method comprising a start-up procedure in which the rotary drive is applied to the driven member with the member already rotating in the drive direction.

The unacceptable clutch orbiting results from failure of the clutch to accommodate itself to misalignment where the shafts, or one of the shafts, which it connects lack adequate stiffness to enforce such accommodation. By effecting clutch engagement with the driven clutch part already rotating in the drive direction the accommodation required of the clutch is reduced to a level at which the necessary adjustment readily ensues.

The preliminary rotation of an unbalanced driven member can be conveniently obtained by initial application of the rotary drive to impart a movement to the member in the drive direction, the drive being discontinued to allow the member to rotate back beyond its initial position and then forward again, so as to then have the desired rotation for again receiving the rotary drive, after which normal operation follows.

The invention accordingly also provides a control system for an installation in which a rotary drive is applied from a motor through a clutch to an unbalanced driven member, for example a grinding mill, the control system comprising means responsive to a start signal to engage the clutch so as to apply the rotary drive to the unbalanced driven member, disconnecting the drive from the member after rotation thereof through a predetermined angle, and again applying the drive after the member has rotated back beyond the starting position and has resumed rotation in the driven direction.

The periods during which the clutch is initially engaged and then disengaged can be preset each being preferably selectively adjustable, or one or both can be condition responsive, as to the angular position of the unbalanced driven member.

BRIEF DESCRIPTION OF THE DRAWINGS

The invention is further described below, by way of example, with reference to the accompanying drawings, in which:

In FIG. 1 of the drawings there is illustrated a grinding mill installation 1 comprising an electric motor 2 of which the rotary output drive is applied to a grinding mill 4 successively through a clutch 5 and gearing 6. The operation of the installation 1 is under control of a controller 9 by which energization of the motor 2 and actuation of the clutch 5 are effected.

Figure 1:
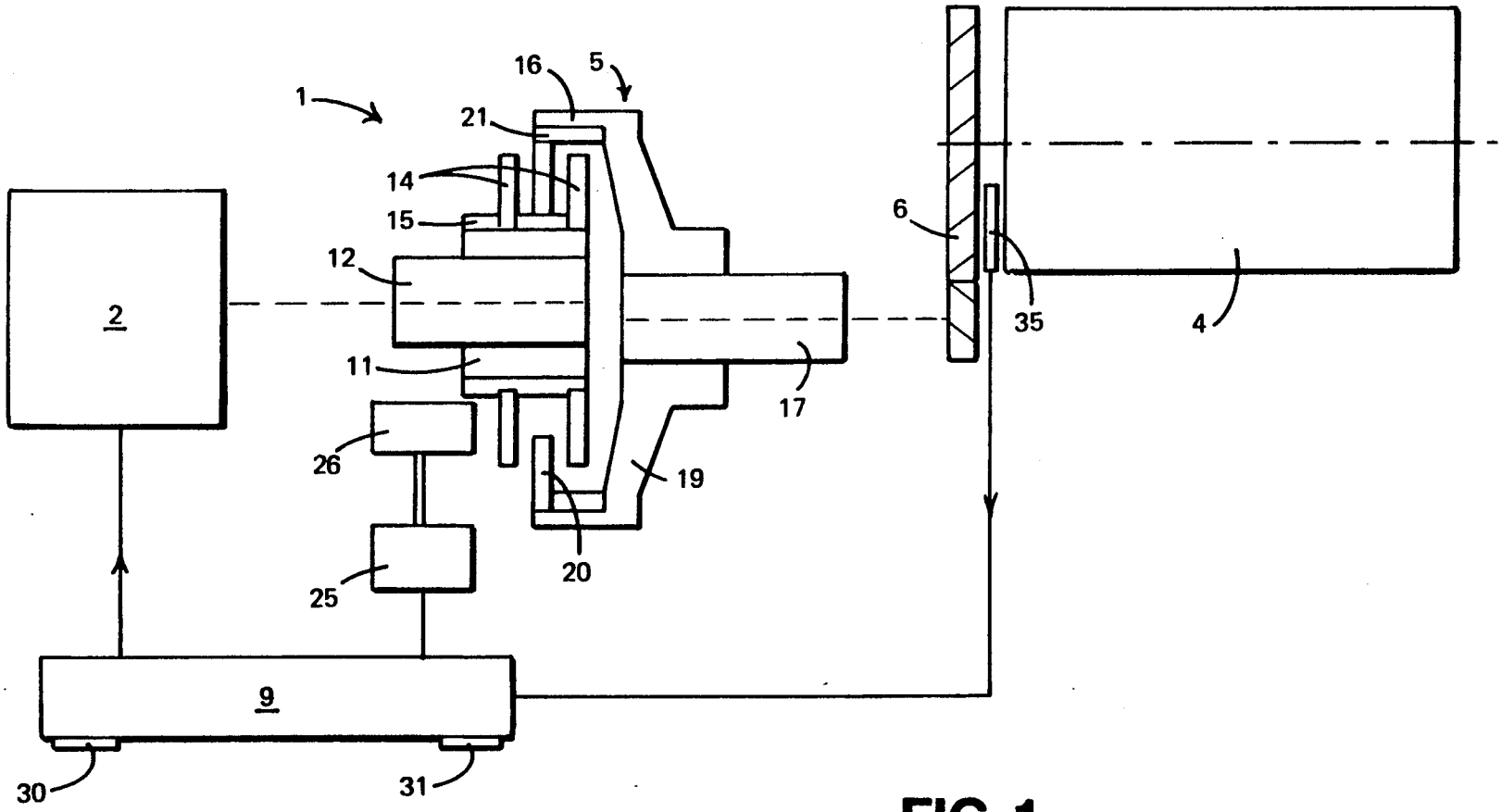
FIG. 1 schematically illustrates a grinding mill installation in accordance with the invention.

The clutch 5 comprises a driving hub 11 mounted on the drive shaft 12 of the electric motor 2. The hub 11 carries two, or typically more, annular driving plates 14 by means of a splined connection 15, such that the plates are capable of limited movement along the hub axis and also radially of the axis. The clutch 5 also comprises a driven outer ring 16 mounted on a shaft 17 by way of a spider member 19. The ring 16 carries at least one annular driven friction disc 20 by a splined connection 21 at the outer edge of the disc, which permits limited axial and radial movement of the disc relative to the axis of the shaft, which may not be aligned with the common axis of the driving hub. 11 and shaft 12. The one or more driven friction disks 20 are received between an adjacent pair of the driving plates 14. The shaft 17 is secured to a pinion of the gearing 6 by which the rotational drive is applied to the grinding mill 4.

The clutch 5 is engaged by supplying pressure air from a source 25 to pneumatic actuators 26 which effect axial compression of the stack of driving plates and friction discs against a return spring.

Figure 2A:
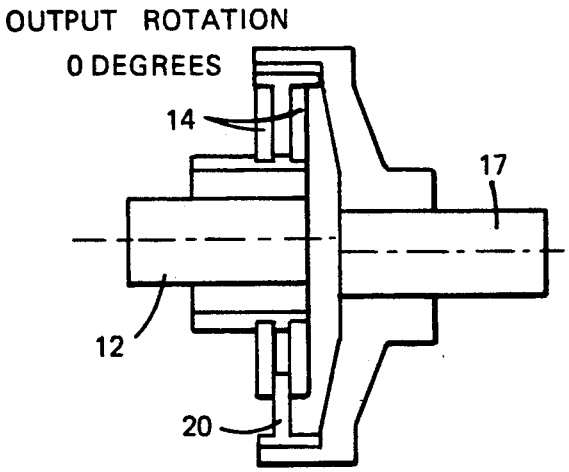
FIGS. 2A & 2B are schematic side views of a clutch incorporated in the installation of FIG. 1 in different respective positions.
Figure 2B:
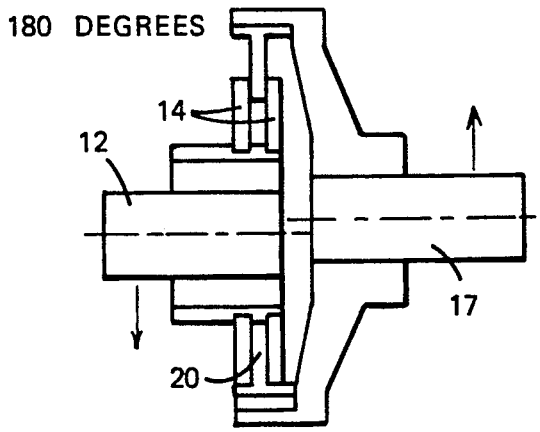

On operation of a start-up press-button 30, the controller 9 first effects energization of the electric motor 2 to set the shaft 12 and the driving hub 11 into rotation. As the driving hub 11 rotates, the driving plates 14 tend to centralise about the driving hub axis under centrifugal force, moving from the positions of FIG. 1 to those of FIG. 2A. The controller 9 now begins engagement of the clutch by operation of the actuators 26, and the friction discs 20 are gripped by the driving plates 14 with the discs in a position offset from the driven ring axis, as shown in FIGS. 2A. As the rotational drive begins to be applied to the grinding mill 4, the friction discs 20 exert a radial force on the outer ring 16 and a reaction force on the driving hub 11, which forces would reach a maximum if the friction discs were rotated through 180°, as illustrated in FIG. 2B, and would return to a minimum if a complete 360° rotation were to be effected. These cyclic forces would be resisted by the stiffnesses of the driving and driven shafts 12 & 17 which, if sufficient, would enforce radial slippage of the friction discs 20. If the shaft stiffnesses were insufficient to occasion this radial slip, the driving hub 11 and the driven ring 16 force each other to deflect in a cyclic manner, that is, clutch orbiting ensues, in an amount dependent on the dimensional relationships of the clutch parts. Because of the substantial weight of the grinding mill, the torque needed to start the mill moving is very large so that correspondingly high forces are generated within the clutch 5. In a typical grinding mill, the pneumatic pressure may reach 1.57 bar, corresponding to a gripping force of 110,000 Newtons.

In accordance with the invention therefore, the controller 9 causes the clutch 5 to be uncoupled after the mill 4 has been rotated initially through a small angle, preferably within the range of 10° to 20°. The mill 4 is of course unbalanced because the load it contains occupies its lowest region, so the mill will begin to rotate in the reverse direction when the clutch 5 is released. The inertial effect of the load will cause the mill to turn back beyond its starting position and then again rotate in the drive direction. As the mill reaches the start position, the controller 9 causes air pressure to be applied to the actuators 26 to effect clutch engagement again.

As a consequence of this procedure, the second engagement of the clutch 5 takes place with the driven friction discs 20 already rotating at a reasonable speed. The radially acting forces when the friction discs 20 have rotated through 180° is substantially reduced. Accordingly, these factors allow the radial slip required between the driving plates 14 and the friction discs 20 to be minimised and to occur without orbiting.

Figure 3:
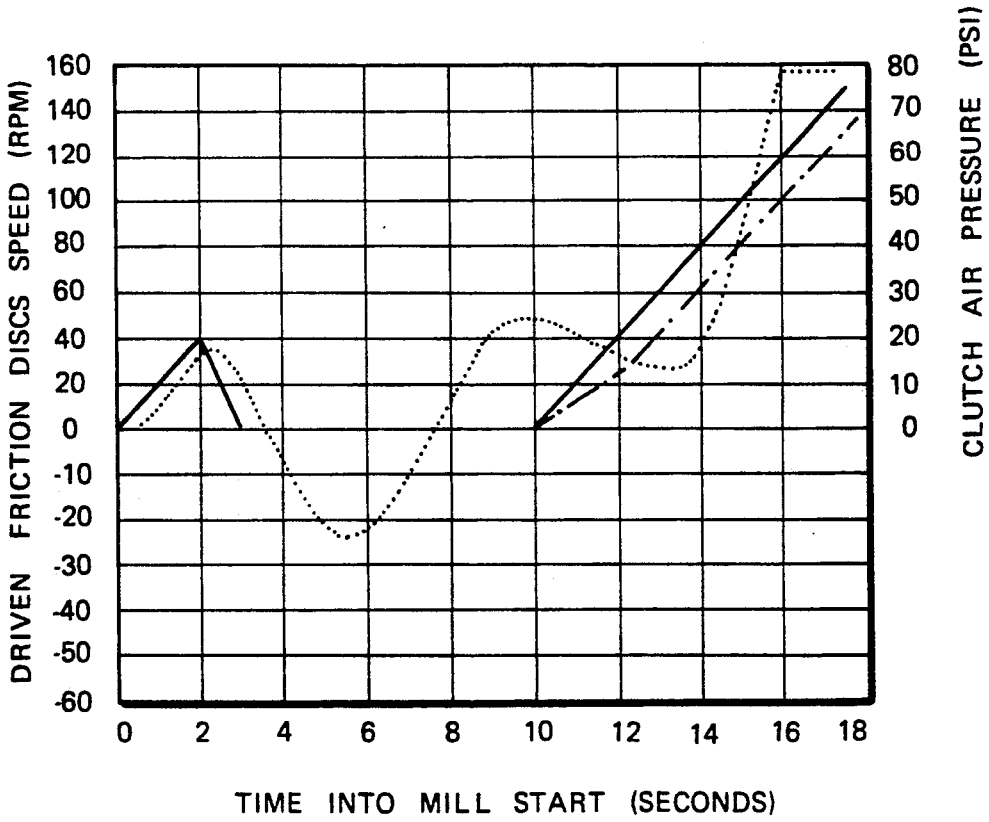
FIG. 3 graphically displays operation of the clutch of FIGS. 2A and 2B during start-up.

An operational sequence is illustrated in FIG. 3, in which the rotational speed of the driven friction discs 20, and the air pressure within the clutch actuators 26 are plotted against time. It will be seen that, on start up, the clutch pressure rises to around 20 psi in the first two seconds and then falls back to zero after three seconds. The friction disc rotational speed changes approximately similarly, but the reverse rotational movement begins before four seconds from the start time and ends just before eight seconds from the start time. At just before 10 seconds from the start time, the mill is rotating through its start position in the driving direction. The clutch 5 is then engaged and driven rotation of the mill in the driving direction follows.

Although the rate of increase of the air pressure applied to the actuators 26 is shown as being uniform, the controller 9 could be arranged to provide for an initial application of this clutch air pressure at a lower rate, as indicated in FIG. 3 by the chain dotted line.

The controller 9 can operate in accordance with a predetermined cycle, but at least one of the periods of initial clutch engagement and subsequent temporary disengagement is preferably selectively adjustable, as by adjustment input means 31 for the controller 9, in dependence on the grinding mill load for example. The one or more periods can instead be dependent on sensed load or performance characteristics of the grinding mill. The angular position of the mill 4 can for example be sensed by a sensor 35 the output of which is supplied to the controller 9.

It is event that those skilled in the art may make numerous modifications of the specific embodiment described above without departing from the present inventive concepts. It is accordingly intended that the invention shall be construed as embracing each and every novel feature and novel combination of features present in or possessed by the apparatus herein described and that the foregoing disclosure shall be read as illustrative and not as limiting except to the extent set forth in the claims appended hereto.

I claim:

1. In a clutch drive system in which a motor drive shaft is selectively coupled to and de-coupled from an unbalanced rotatable load by engagement and disengagement of a clutch adapted to accommodate misalignment between said drive shaft and said rotatable load, start-up control means for said clutch, said control means being programmed to respond to a start-up signal successively to engage said clutch to effect limited rotation of said load from a starting position thereof in a drive direction, to disengage said clutch, and to re-engage said clutch when said load is inertially rotating in said drive direction after having rotated back beyond said starting position.

2. The clutch drive system of claim 1 wherein said control means is adapted to engage and disengage said clutch for fixed predetermined periods.

3. The clutch drive system of claim 1 further comprising means for selectively adjusting at least one of the periods of engagement and disengagement of said clutch.

4. The clutch drive system of claim 1 further comprising sensor means providing an output dependent on the angular position of said clutch, and wherein said control means is responsive to said sensor means output to commence at least one of said disengagement and said re-engagement of said clutch.

5. The clutch drive system of claim 1 wherein said clutch comprises first annular clutch discs carried by and around said drive shaft for limited axial and racial movement, a ring drivingly connected to said load, and second annular clutch discs carried by and within said ring for limited axial and radial movement, said second clutch discs being interleaved with said first clutch discs and frictionally engageable therewith on engagement of said clutch.

6. The clutch drive system of claim 1 wherein said unbalanced load comprises a grinding mill and material charged therein, and further comprising reduction gearing between said clutch and said grinding mill.

7. The clutch drive system of claim 1 wherein said clutch includes pneumatic actuator means operable to effect engagement of said clutch, and wherein said control means effects operation of said actuator means at an initial lower pressure on re-engagement of said clutch.

8. A start-up method for a grinding mill having an unbalanced load, said mill being rotatably drivable from a rotary drive shaft through a clutch adapted to accommodate misalignment between said shaft and said mill, said method comprising the steps of initially engaging said clutch to effect a first rotation of said mill and said unbalanced load in a drive direction;

disengaging said clutch to permit said mill and load to rotate under the weight thereof through a second rotation in the direction reverse to said drive direction, and through a third rotation in said drive direction, and re-engaging said clutch during said third rotation of said mill and said load in said drive direction.

9. A grinding mill apparatus comprising:

a drive motor having a rotary drive shaft, a mill journaled for rotation, a drive train between said drive shaft and said mill, a clutch included in said drive train, said clutch being responsive to a control input to move between an engaged condition and a disengaged condition, said drive shaft being drivingly coupled to said mill through said drive train in said engaged condition of said clutch and decoupled from said mill in said disengaged condition of said clutch, said clutch being adapted to accommodate misalignment in said train, and start-up control means responsive to a start-up command to supply said control input to move said clutch to said engaged condition thereof for a first period sufficient to effect rotation in a drive direction of said mill through less than 180°, to move said clutch to said disengaged condition for a second period sufficient to allow said mill to rotate contrary to said drive direction and to resume rotation in said drive direction, and then to move said clutch to said engaged condition.

10. The apparatus of claim 9 wherein said start-up control means includes means permitting selective adjustment of at least one of said first and second periods.

11. The apparatus of claim 9 further comprising gearing between said clutch and said mill.

12. The apparatus of claim 9 further comprising sensor means providing an output dependent on the angular position of said mill, and wherein at least one of said first and second periods is dependent on said sensor means output.

* * * * *